US009633811B2

(12) United States Patent
Li et al.

(10) Patent No.: US 9,633,811 B2
(45) Date of Patent: Apr. 25, 2017

(54) CIRCUIT BREAKER FOR HIERARCHICALLY CONTROLLING SHORT-CIRCUIT CURRENT AND TRIPS

(71) Applicant: XIAMEN TAIHANG TECHNOLOGY CO., LTD, Xiamen, Fujian (CN)

(72) Inventors: Xin Li, Fujian (CN); Bochen Li, Fujian (CN); Bolin Li, Fujian (CN)

(73) Assignee: XIAMEN TAIHANG TECHNOLOGY CO., LTD, Xiamen (CN)

( * ) Notice: Subject to any disclaimer, the term of this patent is extended or adjusted under 35 U.S.C. 154(b) by 0 days.

(21) Appl. No.: 15/233,949

(22) Filed: Aug. 10, 2016

(65) Prior Publication Data

US 2017/0047183 A1 Feb. 16, 2017

(30) Foreign Application Priority Data

Aug. 10, 2015 (CN) ..... 2015 1 0485176

(51) Int. Cl.

| | |
|---|---|
| ***H01H 7/14*** | (2006.01) |
| ***H01H 55/00*** | (2006.01) |
| ***H01H 33/65*** | (2009.01) |
| ***H01H 33/66*** | (2006.01) |

(52) U.S. Cl.

CPC ..... *H01H 55/00* (2013.01); *H01H 33/62* (2013.01); *H01H 33/66* (2013.01)

(58) Field of Classification Search

CPC ..... H01H 71/44

USPC ..... 335/6, 63

See application file for complete search history.

(56) References Cited

U.S. PATENT DOCUMENTS

| | | | | |
|---|---|---|---|---|
| 2,820,927 | A * | 1/1958 | Steiner | H01H 71/2454 335/256 |
| 5,334,964 | A * | 8/1994 | Voigt | H01F 6/06 335/216 |
| 6,034,586 | A * | 3/2000 | Runyan | H01H 71/1027 218/152 |
| 6,255,923 | B1 * | 7/2001 | Mason, Jr. | H01H 71/123 335/18 |
| 7,085,115 | B2 * | 8/2006 | Elder | H01F 17/02 361/56 |
| 8,134,428 | B2 * | 3/2012 | Watford | H01H 71/02 335/106 |

(Continued)

*Primary Examiner* — Alexander Talpalatski

(57) ABSTRACT

The invention discloses a short circuit current hierarchical control tripping parameter circuit breaker. According to the invention, resistance of an alloy magnetic resistance body is changed through circuit current, and contract control can be carried out on short-circuit current. The control range of the circuit breaker can achieve that no magnetic resistance will be generated when current is no more than 8 times of rated operational current, and current limiting may be realized by the magnetic resistance when current is 8 times more than rated value. In this way, hierarchical control on short-circuit current of different levels of circuits can be carried out, and short-circuit current can be limited in a predetermined range, thereby restricting the short-circuit current in a predetermined range, solving a problem of power supply flickering, and avoiding large-area power failure accidents caused by override trip existing in an electrical control switch.

17 Claims, 2 Drawing Sheets

(56) References Cited

U.S. PATENT DOCUMENTS 8,749,329 B2 * 6/2014 Fasano ..... H01H 71/2409
335/172

* cited by examiner

CIRCUIT BREAKER FOR HIERARCHICALLY CONTROLLING SHORT-CIRCUIT CURRENT AND TRIPS

CROSS REFERENCES TO RELATED APPLICATION

The present application claims priority of Chinese Patent Application No. 201510485176.5 filed on Aug. 10, 2015, the entire content of which is hereby incorporated by reference.

FIELD OF THE INVENTION

The present invention relates to the field of circuit breaker tripping and current limiting control of the power system, more particularly to a circuit breaker which hierarchically controls short-circuit current and trips.

BACKGROUND OF THE INVENTION

Voltage stability is an important index of power supply system, and voltage flicker caused by short fault can do much harm. When the flicker which is also known as interference electricity occurs, the solenoid-operated switch trips due to the loss of excitation, resulting in cut-off of power supply and significant economic losses to production system, data center, etc. Besides, override trip of control switch caused by short-circuit current is always a problem.

In order to resolve this problem, there are two means in the art: the mechanism with double contacts broke down separately, and the current limiting method involving magnetic reluctance caused by electric arc. However, these two means both have a disadvantage that, when instantaneous short circuit current occurs because of short-circuit fault, the circuit breaker does not trip so that current limiting cannot be realized.

In the mechanism with double contacts broke down separately, a resistance body is provided between the auxiliary contact and the main contact, and the main circuit passes through these two contacts to reach another side. When short-circuit fault occurs, the auxiliary contact breaks down at first, the main circuit passes through the resistance body and the main contact, and the produced prospective instantaneous short circuit current is limited in a range of the predetermined value by the resistance body. When the auxiliary contact breaks down, short circuit current is limited in a range under the effect of the resistance, and the main contact breaks down due to the limited short circuit current, whereby the electric arc of contact is controlled and the breaking capacity is improved. It is one existing means. It has a disadvantage that, once the short-circuit fault occurs, instantaneous peak short-circuit current occurs and results in voltage drop and voltage flicker (interference electricity). The most serious problem caused by peak short-circuit current is the override trip problem, which is a safety problem that cannot be ignored.

In the short-circuit current limiting method involving magnetic reluctance caused by electric arc, when the short-circuit fault occurs, the contact breaks down and the breaking arc generates arc magnetic field, so that the magnetic field force restrains the growth of electric arc and thus short circuiting arc is restrained. It has a disadvantage that, once short-circuit fault occurs, instantaneous peak short-circuit current occurs and results in voltage drop and voltage flicker (interference electricity). The most serious problem caused by peak short-circuit current is the override trip problem, which is a safety problem that cannot be ignored.

That is, the existing circuit breaker trips in such a manner that the main contact and the auxiliary contact break down separately. Since a resistance is connected in series between the auxiliary contact and the main contact, the tripping may be realized only when short-circuit fault occurs. However, in this situation, drop-away current limiting is realized after voltage flicker caused by short-circuit current happens. Also, in the circuit breaker which uses electric arc to limit short-circuit current, voltage flicker happens before the tripping, and drop-away current is limited by contact arc after the tripping.

As to the power supply circuit, short-circuit fault is very dangerous. The circuit-breaker, which solves short circuit breaking problem, does not solve the existing voltage flicker problem. The flicker problem and override trip problem are most serious problems of the power supply system, which may result in forced outage, breaking off of big data exchange operation, breaking down of important equipment, shutting down of production line, etc. In order to eliminate flicker in power grid, short-circuit current should be stably limited in a range without peak value during the entire short-circuit fault.

SUMMARY OF THE INVENTION

The present invention aims to solve the technical problem of slow response speed of the existing means, i.e., the double contacts technique and the technique of limiting current by electric arc, and the technical problems of voltage flicker caused by transient short-circuit current and operated protection of sensitive electrical equipment.

In order to solve the above technical problems, the present invention provides a circuit breaker which hierarchically controls short-circuit current and trips, comprising a trip mechanism, a movable contact, and a stationary contact, and characterized in that: it further comprises an electromagnet and magnetoresistive component; wherein the movable contact, the stationary contact and the magnetoresistive component are arranged in main circuit of the circuit-breaker; wherein the movable contact is associated with the trip mechanism; wherein the magnetoresistive component comprises a magnetic reluctance body and a solenoid coil wound around the magnetic reluctance body, wherein the solenoid coil has two ends, one of which is connected with one end of the magnetic reluctance body and the other of which is connected with a current output port, and the other end of the magnetic reluctance body is connected with the current input port; when exciting current flows through the magnetoresistive component, current limiting can be realized due to magnetoresistance generated by the magnetoresistive component, and a movable iron core of the electromagnet hits the trip mechanism, the trip mechanism completes tripping and meanwhile the movable contact and the stationary contact are switched from a contact state to a separate state.

Preferably, the exciting current value is in inverse proportion to the number of turns of the solenoid coil, wherein the exciting current of the magnetoresistive component can be determined by the formula $H=N\times I/Le$, wherein H indicates magnetic field strength, I indicates exciting current, and Le indicates core effective path length.

The circuit breaker which hierarchically controls short-circuit current and trips according to the present invention may further comprises a controller and a current sensor, wherein the current sensor sends the detected signal of the current flowing through the magnetoresistive component to the controller, and the controller controls the movable iron core of the electromagnet to move when exciting current flows through the magnetoresistive component.

Preferably, the electromagnet comprises an electromagnet coil which is connected with the end of the solenoid coil to which the current output port is connected. When exciting current flows through the magnetoresistive component, the movable iron core of the electromagnet moves.

Preferably, a thermal insulation material is arranged between the magnetic reluctance body and the solenoid coil.

Optionally, the thermal insulation material may be ceramics, glass, mica, polyphenylene sulfide plastic or polytetrafluoroethylene.

Preferably, the circuit breaker is a single phase or three-phase circuit breaker with a magnetoresistive component connected in series in both main circuit and branch circuit.

Optionally, the circuit breaker may be air circuit breaker or vacuum circuit breaker.

Optionally, the circuit breaker may be miniature circuit breaker, molded case circuit breaker, or air-operated circuit breaker.

Preferably, the magnetic reluctance body is an elongated shaped alloy magnetic reluctance body, which is made of one or more materials of iron alloy, copper alloy and aluminium alloy, and the solenoid coil is made of copper.

Furthermore, the circuit breaker which hierarchically controls short-circuit current and trips further comprises an arc-control device for bouncing to achieve arc suppression when supply current is limited by the magnetoresistive component.

Furthermore, the arc-control device comprises an arc chute for extinguishing the arc generated between the stationary contact and the movable contact.

As shown in FIG. 5, when current flows in opposite direction, the magnetic field is generated in opposite direction. When current flows through the solenoid coil, magnetic field is generated around the solenoid coil. When the solenoid coil is wound around the alloy magnetic reluctance body, the greater the density of magnetic induction lines passing through the alloy magnetic reluctance body, the stronger the magnetic field is, and resistance of the alloy magnetic reluctance body increases. When circuit fault occurs, for example transient short-circuit current occurs, the increase of current can be limited in a range due to the instantaneous increase of resistance of the alloy magnetic reluctance body, whereby short-circuit current can be limited in a predetermined range.

The magnetoresistive component can be applied to a circuit breaker. In case short-circuit current occurs in the circuit breaker, when short-circuit current increases to 8 times more than rated operational current, the resistance of the alloy magnetic reluctance body increases and limits the rise of short-circuit current, the trip mechanism trips quickly due to the limited short-circuit current, the arc is also extinguished due to the limited short-circuit current, and the decrease of power voltage is limited in a predetermined range.

The circuit breaker which hierarchically controls short-circuit current and trips according to the present invention has advantages as follows:

1. The alloy magnetic reluctance body of the present invention has a resistance which can increase with current in the circuit, so that the increase of current can be limited in a range when short-circuit occurs in the circuit. Meanwhile, when the circuit returns to normal working condition, the resistance of the alloy magnetic reluctance body is able to return to normal value quickly.

2. When the running current is 6 to 8 times more than rated current, the magnetic field generated by the solenoid coil 4 is not enough to enable the change of the resistance of the alloy magnetic reluctance body of the present invention.

3. In the present invention, the resistance of the alloy magnetic reluctance body is changed through circuit current, so that contract control can be carried out on short circuit current. The control range can be so big that, no magnetic resistance will be generated when current is no more than 8 times of rated operational current, and current limiting may be realized by the magnetic resistance when current is 8 times more than rated value. In this way, hierarchical control on short-circuit current of different levels of circuits with control switch short circuit fault can be carried out. When short-circuit faults occur in different positions, the short-circuit currents can be limited in a predetermined range, thereby maintaining the power voltage in a stable range, limiting the decrease range of power voltage, and avoiding large-area power failure accidents caused by override trip.

4. When large current flows through, the resistance of the alloy magnetic reluctance body increases quickly, and resistance heat is generated in the alloy magnetic reluctance body which is wound with coils. At this point, the resistance heat problem can be solved by providing thermal insulation material.

BRIEF DESCRIPTION OF THE DRAWINGS

In order to better explain the technical solutions of the embodiments according to the present invention or that in the art, accompanying figures in combination with the description are briefly introduced as below. Apparently, these figures merely illustrate some embodiments. On the basis of these figures, those skilled in the art may get other more figures without inventive step.

In the figures: 1. magnetoresistive component; 2. external resistor; 3. magnetic reluctance body; 4. solenoid coil; 5. first end; 6. second end; 7. current input port; 8. movable iron core; 9. electromagnet coil; 10. trip mechanism; 11. moving contact; 12. stationary contact; 13. arc chute.

DETAILED DESCRIPTION OF ILLUSTRATED EMBODIMENTS

The present invention will be further explained below in detail with reference to figures and particular embodiments. It is apparent that the described embodiments are merely some embodiments of the present invention, but are not to limit the invention in any form. The present invention is intended to cover all equivalent arrangements included within the principle of the present invention according to the technical essence of the present invention.

Embodiment 1

Figure 3:
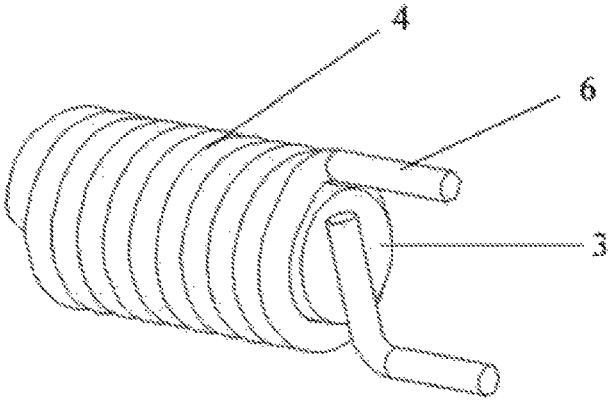
FIG. 3 is another schematic diagram of the magnetoresistive component according to the present invention.
Figure 4:
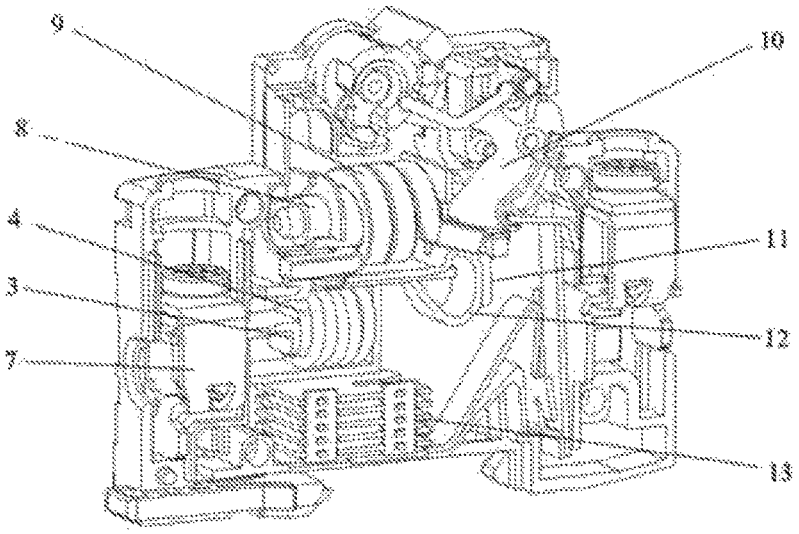
FIG. 4 is a schematic diagram of a circuit breaker which hierarchically controls short-circuit current and trips according to the present invention.
Figure 5:
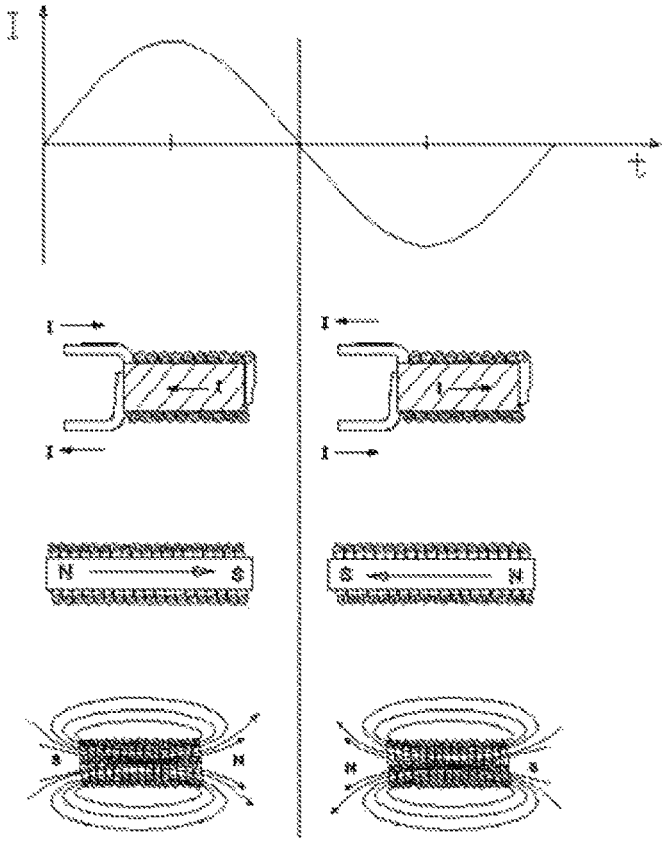
FIG. 5 is a schematic diagram illustrating induced magnetic fields with electric current flowing in different directions.

The present invention provides a circuit breaker which hierarchically controls short-circuit current and trips, comprising a trip mechanism 10, a movable contact 11, and a stationary contact 12, and characterized in that: it further comprises an electromagnet and magnetoresistive component 1; wherein the movable contact 11, the stationary contact 12 and the magnetoresistive component 1 are all arranged in a main circuit of the circuit-breaker; wherein the movable contact 11 is associated with the trip mechanism 10; wherein the magnetoresistive component 1 comprises a magnetic reluctance body 3 and a solenoid coil 4 wound around the magnetic reluctance body 3, wherein the solenoid coil 4 has two ends, one of which is connected with one end of the magnetic reluctance body 3 as shown in FIG. 3 and the other of which is connected with a current output port, and the other end of the magnetic reluctance body 3 is connected with the current input port 7 as shown in FIG. 4; wherein the magnetic reluctance body 3 is preferably an elongated shaped alloy magnetic reluctance body; when exciting current flows through the magnetoresistive component 1, current limiting can be realized due to magnetoresistance generated by the magnetoresistive component 1, and a movable iron core 8 of the electromagnet hits the trip mechanism 10 to realize trip and meanwhile the movable contact 11 and the stationary contact 12 are switched from a contact state to a separate state.

In this embodiment, a thermal insulation material is arranged between the magnetic reluctance body 3 and the solenoid coil 4, such as ceramics, glass, mica, polyphenylene sulfide plastic or polytetrafluoroethylene.

In this embodiment, the movement of the electromagnet is controlled by a controller and a current sensor. The current sensor detects the current flowing through the magnetoresistive component 1, and the controller controls the movable iron core 8 of the electromagnet to move and hit the trip mechanism 10 when the detected current signal is a predetermined exciting current value.

Preferably, the single phase or three-phase circuit breaker is connected with magnetoresistive components 1 in series in both main circuit and branch circuit. The circuit breaker may be classified into many types, such as air circuit breaker or vacuum circuit breaker, or miniature circuit breaker, molded case circuit breaker, or air-operated circuit breaker.

The magnetoresistive component 1 according to the present invention can be applied to a miniature circuit breaker switch with an alternating voltage of 220V and a rated current of 32 A. The miniature circuit breaker switch comprises a current sensor, an electromagnet including an electromagnet coil 9 and a movable iron core 8, an arc-control device, a stationary contact 12, and a trip mechanism 10 arranged with a movable contact 11, wherein the current sensor comprises the above mentioned magnetoresistive component for limiting the current flowing into the circuit breaker. The current flows in from one end of the magnetic reluctance body 3, and flows out through a second end 6 of the solenoid coil 4 which is connected with the electromagnet coil 9. When the magnetoresistive component limits the supply current, the movable iron core 8 hits the trip mechanism 10 to realize trip, and meanwhile the movable contact 11 and the stationary contact 12 are switched from a contact state to a separate state. The arc-control device is used for bouncing to achieve arc suppression when the supply current is limited by the magnetoresistive component, wherein the arc-control device comprises an arc chute 13 for extinguishing the arc generated between the stationary contact 12 and the movable contact 11.

In order to prevent the short circuit current from increasing once it reaches 1200 A (the reason why 1200 A is selected here is that the network voltage flicker will not occurs if the short circuit current is less than 1200 A in end users), an iron magnetic reluctance body 3 with a magnetic field strength of 448000 A/m and a varying resistance can be selected, electrical resistivity $\rho=0.32\ \Omega\cdot mm^2/m$, $\Delta\rho=70.65\ \Omega\cdot mm^2/m$, and resistance of the magnetic reluctance body can be calculated by the formula $R=\rho L/s$. At first, the solenoid coil 4 in this embodiment is designed with a length of 20 mm, a maximum external diameter of 10 mm, and the rated current is 32 A. If taking it as 5 A per square millimeter, unheated section is $32/5=6.4\ mm^2$, so $7\ mm^2$ may be selected for safer operation, that is, a diameter of 3 mm and a length of 32 mm if illustrated by circle, so as to meet safety.

On the basis of formulas, it can be calculated that, normal state resistance of the magnetic reluctance body $R=\rho L/s=0.32\times0.020/(3/2)^2\pi=0.0064/7.065=0.0009058\Omega$, variable resistance of the magnetic reluctance body $\Delta R=\pi L/s=70.65\times0.020/(3/2)^2\pi=1.413/7.065=0.2\Omega$. In particular, the exciting current value is in inverse proportion to the number of turns of the solenoid coil 4. On the basis of the formula for calculating magnetic field strength $H=N\times I/Le$, wherein H indicates magnetic field strength, I indicates exciting current, and Le indicates core effective path length, it can be calculated that, $448000=N\times1200/0.020$, and therefore $N=LH/I=0.020\times448000/1200\approx7$.

If the solenoid is made of copper, taking the carrying current as 6 A per square millimeter of cross section, when the rated current is 32 A, the cross section should be no less than $5.3\ mm^2$, that is, 2.6 mm if illustrated by a raw material diameter, and thus a diameter of 3 mm may be selected for safer operation. To meet the technical requirements, the solenoid coil 4 should have an internal diameter of no less than 3 mm, an effective length of 20 mm, a width of each lap of solenoid material of 20/7=2.86 mm, so that 2×3 flat-shaped copper wire may be selected to wind into a solenoid with an external diameter of about 9 mm.

The magnetic field strength in the solenoid interior is basically constant, influences of environment magnetic field and electromagnetic field to the resistance of the magnetic reluctance body are so little that these can be ignored, and the resistance of the magnetic reluctance body only changes when short circuit current flows through the solenoid which results in high magnetic field. The resistance of the magnetic reluctance body according to the present invention in normal state is 0.00090587 ohm. When short-circuit fault occurs, short circuit current increases to 1200 A, then the resistance of the magnetic reluctance body changes into 0.2 ohm rapidly and the short circuit current is limited at 1200 A, whereby voltage flicker can be avoided, and override trip and forced outage can be prevented.

The present invention has a main concept that current is self-limited by the tripping of circuit breaker and the breaking of circuit, that is, the current creates a magnetic field, and the magnetic field changes a magnetoresistance of the alloy body, then a circuital current is limited by the magnetic reluctance, thereby forming a closed-loop control by which the short-circuit current can be stably limited and realizing synchronization of response.

1. Since the resistance of the magnetic reluctance body changes depending on magnetic field, the magnetic field changes depending on current, and the short-circuit current changes depending on line impedance and voltage capacity, such response speed to changes is electron velocity. Therefore, the magnetic reluctance body is an ideal element for current limiting.

2. If continuous instantaneous peak current occurs in the circuit in an extremely short period of time, following changes cannot be caused by double-contact switch or electric arc current limiting techniques, because once the following changes happen, the circuit will be cut off and cannot return to stable working condition again, so that current limiting cannot be realized.

Figure 1:
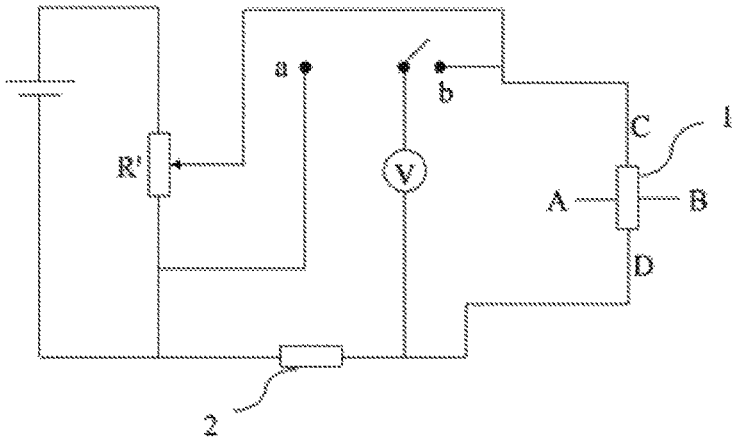
FIG. 1 is a working principle diagram of magnetoresistive effect.

According to the principle that some special alloy conducting materials have resistance values changed with the changes of their external magnetic fields under certain conditions, these conducting materials can be used for limiting current based on their characteristic. When the special alloy conducting material is positioned in a magnetic field, charge carriers of the special alloy conducting material are deflected by Lorentz force so that accumulated charges are produced at the two ends and Hall electric field is generated. If Hall electric field produces a force which can exactly counteract the Lorentz force of a charge carrier at a certain speed, the charge carriers at a speed above or below this certain speed will be deflected, so that the number of charge carriers which move along the direction of external magnetic field decreases and thus the resistance increases. Referring to FIG. 1, the magnetoresistive effect will be more apparent if the end A and the end B in FIG. 1 are shorted. Since the magnetic reluctance is usually indicated by relative change of electrical resistance and meanwhile relative variation ratio of resistance is in direct proportion to the relative change of electrical resistance, the magnetoresistive effect can also be indicated by relative change of resistance. If metal or semiconductor is positioned in a weak magnetic field, the relative variation ratio of general resistor is in direct proportion to the square of magnetic induction intensity, and if in an intense magnetic field, the relative variation ratio of resistor is linear to the magnetic induction intensity. As shown in FIG. 1, a magnetoresistive component under a magnetic field is connected with an external resistor 2 in a bleeder circuit of a constant-current source, the current flows through the magnetoresistive component may be controlled by adjusting R', and the voltages of the external resistor 2 and the magnetoresistive component may be respectively measured by connecting a or b with a voltmeter.

Embodiment 2

Figure 2:
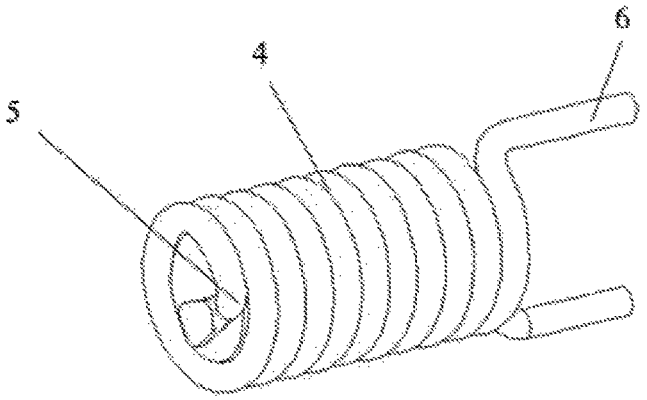
FIG. 2 is a schematic diagram of a magnetoresistive component according to the present invention.

The present invention provides a circuit breaker which hierarchically controls short-circuit current and trips, comprising a magnetic reluctance body 3 and a solenoid coil 4 wound around the magnetic reluctance body 3, wherein the solenoid coil 4 has two ends, i.e., a first end 5 and a second end 6 as shown in FIG. 2, wherein the magnetic reluctance body 3 has one end connected with the first end 5 of the solenoid coil 4, and the other end connected with the current input port 7, and the second end 6 of the solenoid coil 4 is connected with a current output port. According to the formula $H=N\times I/Le$, the number N of turns of the solenoid coil 4 can be calculated, wherein H indicates magnetic field strength, I indicates exciting current, and Le indicates core effective path length. The alloy magnetic reluctance body may be elongated shaped, a thermal insulation material may be arranged between the alloy magnetic reluctance body and the solenoid coil, and the thermal insulation material may be polyphenylene sulfide plastic.

In this embodiment, the electromagnet coil 9 of the electromagnet is connected with the end of the solenoid coil 4 that connecting the current output port. When the current flowing through the magnetoresistive component 1 reaches a pre-determined exciting current value, the movable iron core 8 of the electromagnet moves to hit the trip mechanism.

The magnetoresistive component according to the present invention can be applied to a three-phase circuit breaker switch with an alternating voltage of 220V and a rated current of 100 A. The three-phase circuit breaker switch comprises a current sensor, an electromagnet including an electromagnet coil 9 and a movable iron core 8, an arc-control device, a stationary contact 12, and a trip mechanism 10 arranged with a movable contact 11, wherein the current sensor comprises the above mentioned magnetoresistive component for limiting the current flowing into the circuit breaker. The current flows in from one end of the magnetic reluctance body 3, and flows out through a second end 6 of the solenoid coil 4, and the second end 6 is connected with the electromagnet coil 9. When the magnetoresistive component limits the supply current, the movable iron core 8 hits the trip mechanism 10 to realize trip, and meanwhile the movable contact 11 and the stationary contact 12 are switched from a contact state to a separate state. The arc-control device is used for bouncing to achieve arc suppression when the supply current is limited by the magnetoresistive component, wherein the arc-control device comprises an arc chute 13 for extinguishing the arc generated between the stationary contact 12 and the movable contact 11.

In order to prevent the short circuit current from increasing once it reaches 2.2 kA, a copper magnetic reluctance body 3 with a magnetic field strength of 448000 A/m and a varying resistance can be selected, electrical resistivity $\rho=0.32\ \Omega\cdot mm^2/m$, $\Delta\rho=70.65\ \Omega\cdot mm^2/m$, and resistance of the magnetic reluctance body can be calculated by the formula $R=\rho L/s$. At first, the solenoid coil 4 in this embodiment is designed with a length of 30 mm, a maximum external diameter of 15 mm, and the rated current is 100 A. If taking it as 5 A per square millimeter, unheated section is $100/5=20\ mm^2$, that is, a diameter of 5 mm and a length of 30 mm if illustrated by circle, so as to meet safety.

According to formulas, it can be calculated that, normal state resistance of the magnetic reluctance body $R=\rho L/s=0.32\times0.030/(5/2)^2\ \pi=0.008/19.625=0.00048917\Omega$, variable resistance of the magnetic reluctance body $\Delta R=\rho L/s=70.65\times0.030/(5/2)^2\ \pi=1.76625/19.625=0.108\Omega$. On the basis of the formula for calculating magnetic field strength $H=N\times I/Le$, it can be calculated that, $448000=N\times2200/0.030$, and therefore $N=LH/I=0.030\times448000/2200\approx6$.

If the solenoid is made of pure copper, taking the carrying current as 6 A per square millimeter of cross section, when the rated current is 100 A, the cross section should be no less than 17 $mm^2$, that is, 4.6 mm if illustrated by a raw material diameter, and thus a diameter of 5 mm may be selected for safer operation. To meet the technical requirements, the solenoid coil 4 should have an internal diameter of no less than 5 mm, an effective length of 30 mm, a width of each lap of solenoid material of 30/6=5 mm, so that 5×4 flat-shaped copper wire may be selected to wind into a solenoid with an external diameter of about 15 mm.

The magnetic field strength in the solenoid interior is basically constant, influences of environment magnetic field and electromagnetic field to the resistance of the magnetic reluctance body are so little that these can be ignored, and the resistance of the magnetic reluctance body only changes when short circuit current flows through the solenoid which results in high magnetic field. The resistance of the magnetic reluctance body according to the present invention in normal state is 0.00048917 ohm. When short-circuit fault occurs, short circuit current increases to 2.2 kA, then the resistance of the magnetic reluctance body changes into 0.108 ohm rapidly and the short circuit current is limited at 2.2 kA, whereby voltage flicker can be avoided, and override trip and forced outage can be prevented.

Embodiment 3

The present invention provides a circuit breaker which hierarchically controls short-circuit current and trips, comprising a magnetic reluctance body 3 and a solenoid coil 4 wound around the magnetic reluctance body 3, wherein the solenoid coil 4 has two ends, i.e., a first end 5 and a second end 6, wherein the magnetic reluctance body 3 has one end connected with the first end 5 of the solenoid coil 4, and the other end connected with the current input port 7, and the second end 6 of the solenoid coil 4 is connected with a current output port. According to the formula H=N×I/Le, the number N of turns of the solenoid coil 4 can be calculated, wherein H indicates magnetic field strength, I indicates exciting current, and Le indicates core effective path length. The alloy magnetic reluctance body may be elongated shaped, a thermal insulation material may be arranged between the alloy magnetic reluctance body and the solenoid coil, and the thermal insulation material may be polyphenylene sulfide plastic.

The magnetoresistive component according to the present invention can be applied to a three-phase circuit breaker switch with an alternating voltage of 220V and a rated current of 300 A. The three-phase circuit breaker switch comprises a current sensor, an electromagnet including an electromagnet coil 9 and a movable iron core 8, an arc-control device, a stationary contact 12, and a trip mechanism 10 arranged with a movable contact 11, wherein the current sensor comprises the above mentioned magnetoresistive component for limiting the current flowing into the circuit breaker. The current flows in from one end of the magnetic reluctance body 3, and flows out through a second end 6 of the solenoid coil 4, and the second end 6 is connected with the electromagnet coil 9. When the magnetoresistive component limits the supply current, the movable iron core 8 hits the trip mechanism 10 to realize trip, and meanwhile the movable contact 11 and the stationary contact 12 are switched from a contact state to a separate state. The arc-control device is used for bouncing to achieve arc suppression when the supply current is limited by the magnetoresistive component, wherein the arc-control device comprises an arc chute 13 for extinguishing the arc generated between the stationary contact 12 and the movable contact 11.

In order to prevent the short circuit current from increasing once it reaches 5 kA, an aluminum magnetic reluctance body 3 with a magnetic field strength of 448000 A/m and a varying resistance can be selected, electrical resistivity $\rho=0.32\ \Omega\cdot mm^2/m$, $\Delta\rho=70.65\ \Omega\cdot mm^2/m$, and resistance of the magnetic reluctance body can be calculated by the formula $R=\rho L/s$. At first, the solenoid coil 4 in this embodiment is designed with a length of 40 mm, a maximum external diameter of 35 mm, and the rated current is 300 A. The magnetic reluctance body is not made of pure copper. If taking it as 5 A per square millimeter, unheated section is $300/5=60\ mm^2$, that is, a diameter of 8.74 mm which may be rounded up to 9 and a length of 40 mm if illustrated by circle, so as to meet safety.

According to formulas, it can be calculated that, normal state resistance of the magnetic reluctance body $R=\rho L/s=0.32\times0.040/(12/2)^2\ \pi=0.0128/63.585=0.00201\Omega$, variable resistance of the magnetic reluctance body $\Delta R=\rho L/s=70.65\times0.040/(9/2)^2\ \pi=2.826/63.585=0.044\Omega$. On the basis of the formula for calculating magnetic field strength H=N×I/Le, it can be calculated that, 448000=N×5000/0.040, and therefore N=LH/I=0.040×448000/5000≈4.

If the solenoid is made of pure copper, taking the carrying current as 6 A per square millimeter of cross section, when the rated current is 300 A, the cross section should be no less than 50 $mm^2$, that is, 8 mm if illustrated by a raw material diameter. To meet the technical requirements, the solenoid coil 4 should have an internal diameter of no less than 12 mm, an effective length of 40 mm, a width of each lap of solenoid material of 40/4=10 mm, so that a round copper wire with a diameter of 8 mm may be selected to wind into a solenoid with an external diameter of about 30 mm.

The magnetic field strength in the solenoid interior is basically constant, influences of environment magnetic field and electromagnetic field to the resistance of the magnetic reluctance body are so little that these can be ignored, and the resistance of the magnetic reluctance body only changes when short circuit current flows through the solenoid which results in high magnetic field. The resistance of the magnetic reluctance body according to the present invention in normal state is 0.00201 ohm. When short-circuit fault occurs, short circuit current increases to 5 kA, then the resistance of the magnetic reluctance body changes into 0.044 ohm rapidly and the short circuit current is limited at 5 kA, whereby voltage flicker can be avoided, and override trip and forced outage can be prevented.

The circuit breaker which hierarchically controls short-circuit current and trips according to the present invention has advantages as follows:

1. The alloy magnetic reluctance body of the present invention has a resistance which can increase with current in the circuit, so that the increase of current can be limited in a range when short-circuit occurs. Meanwhile, when the circuit returns to normal working condition, the resistance of the alloy magnetic reluctance body is able to return to normal value quickly.

2. When the running current is 6 to 8 times more than rated current, the magnetic field generated by the solenoid coil 4 is not enough to enable the change of the resistance of the alloy magnetic reluctance body of the present invention.

3. In the present invention, the resistance of the alloy magnetic reluctance body is changed through circuit current, so that contract control can be carried out on short circuit current. The control range can be so big that, no magnetic resistance will be generated when current is no more than 8 times of rated operational current, and current limiting may be realized by the magnetic resistance when current is more than 8 times of rated value. In this way, hierarchical control on short-circuit current of different levels of circuits can be carried out. When short-circuit faults occur in different positions, the short-circuit currents can be limited in a desired range, thereby maintaining the power voltage in a stable range, and avoiding large-area power failure accidents caused by override trip.

4. When large current flows through, the resistance of the alloy magnetic reluctance body increases quickly, and resistance heat is generated in the alloy magnetic reluctance body which is wound with coils. At this point, the resistance heat problem can be solved by providing thermal insulation material.

All the above are the preferred embodiments of the present invention. Those skilled in the art may change or modify the above disclosed technical contents to obtain equivalent embodiments without departing from the scope of the present invention.

What is claimed is:

1. A circuit breaker which hierarchically controls short-circuit current and trips, comprising a trip mechanism (10), a movable contact (11), and a stationary contact (12), characterized in that: it further comprises an electromagnet and magnetoresistive component (1); wherein the movable contact (11), the stationary contact (12) and the magnetoresistive component (1) are arranged in main circuit of the circuit-breaker, and the movable contact (11) is associated with the trip mechanism (10);

wherein the magnetoresistive component (1) comprises a magnetic reluctance body (3) and a solenoid coil (4) wound around the magnetic reluctance body (3), the solenoid coil (4) has two ends, the magnetic reluctance body (3) has one end connected with one end of the solenoid coil (4) and the other end connected with the current input port (7), the other end of the solenoid coil (4) is connected with a current output port;

when exciting current flows through the magnetoresistive component (1), magnetoresistance is generated by the magnetoresistive component (1) so that current limiting can be realized, and a movable iron core (8) of the electromagnet moves and hits the trip mechanism (10), the trip mechanism (10) completes tripping and meanwhile the movable contact (11) and the stationary contact (12) are switched from a contact state to a separate state.

2. The circuit breaker which hierarchically controls short-circuit current and trips according to claim 1, characterized in that: exciting current value is in inverse proportion to the number of turns of the solenoid coil (4), wherein the exciting current of the magnetoresistive component (1) can be determined by the formula $H=N\times I/Le$, wherein H indicates magnetic field strength, I indicates exciting current, and Le indicates core effective path length.

3. The circuit breaker which hierarchically controls short-circuit current and trips according to claim 2, characterized in that: it further comprises a controller and a current sensor, wherein the current sensor sends the detected signal of the current flowing through the magnetoresistive component (1) to the controller, and when exciting current flows through the magnetoresistive component (1), the controller controls the movement of the movable iron core (8) of the electromagnet.

4. The circuit breaker which hierarchically controls short-circuit current and trips according to claim 2, characterized in that: the electromagnet further comprises an electromagnet coil (9) which is connected with the end of the solenoid coil (4) to which the current output port is connected, when exciting current flows through the magnetoresistive component (1), the movable iron core (8) of the electromagnet moves.

5. The circuit breaker which hierarchically controls short-circuit current and trips according to claim 1, characterized in that: a thermal insulation material is arranged between the magnetic reluctance body (3) and the solenoid coil (4).

6. The circuit breaker which hierarchically controls short-circuit current and trips according to claim 5, characterized in that: the thermal insulation material may be ceramics, glass, mica, polyphenylene sulfide plastic or polytetrafluoroethylene.

7. The circuit breaker which hierarchically controls short-circuit current and trips according to claim 5, characterized in that: the single phase or three-phase circuit breaker is connected in series with the magnetoresistive component (1) in both main circuit and branch circuit.

8. The circuit breaker which hierarchically controls short-circuit current and trips according to claim 5, characterized in that: the circuit breaker is an air circuit breaker or a vacuum circuit breaker.

9. The circuit breaker which hierarchically controls short-circuit current and trips according to claim 5, characterized in that: the circuit breaker is a miniature circuit breaker, a molded case circuit breaker, or a frame circuit breaker.

10. The circuit breaker which hierarchically controls short-circuit current and trips according to claim 1, characterized in that: the magnetic reluctance body (3) is an elongated shaped alloy magnetic reluctance body, the magnetic reluctance body (3) is made of one or more materials of iron alloy, copper alloy and aluminium alloy, and the solenoid coil (4) is made of copper.

11. The circuit breaker which hierarchically controls short-circuit current and trips according to claim 2, characterized in that: the magnetic reluctance body (3) is an elongated shaped alloy magnetic reluctance body, the magnetic reluctance body (3) is made of one or more materials of iron alloy, copper alloy and aluminium alloy, and the solenoid coil (4) is made of copper.

12. The circuit breaker which hierarchically controls short-circuit current and trips according to claim 3, characterized in that: the magnetic reluctance body (3) is an elongated shaped alloy magnetic reluctance body, the magnetic reluctance body (3) is made of one or more materials of iron alloy, copper alloy and aluminium alloy, and the solenoid coil (4) is made of copper.

13. The circuit breaker which hierarchically controls short-circuit current and trips according to claim 4, characterized in that: the magnetic reluctance body (3) is an elongated shaped alloy magnetic reluctance body, the magnetic reluctance body (3) is made of one or more materials of iron alloy, copper alloy and aluminium alloy, and the solenoid coil (4) is made of copper.

14. The circuit breaker which hierarchically controls short-circuit current and trips according to claim 6, characterized in that: the magnetic reluctance body (3) is an elongated shaped alloy magnetic reluctance body, the magnetic reluctance body (3) is made of one or more materials of iron alloy, copper alloy and aluminium alloy, and the solenoid coil (4) is made of copper.

15. The circuit breaker which hierarchically controls short-circuit current and trips according to claim 7, characterized in that: the magnetic reluctance body (3) is an elongated shaped alloy magnetic reluctance body, the magnetic reluctance body (3) is made of one or more materials of iron alloy, copper alloy and aluminium alloy, and the solenoid coil (4) is made of copper.

16. The circuit breaker which hierarchically controls short-circuit current and trips according to claim 8, characterized in that: the magnetic reluctance body (3) is an elongated shaped alloy magnetic reluctance body, the magnetic reluctance body (3) is made of one or more materials of iron alloy, copper alloy and aluminium alloy, and the solenoid coil (4) is made of copper.

17. The circuit breaker which hierarchically controls short-circuit current and trips according to claim 9, characterized in that: the magnetic reluctance body (3) is an elongated shaped alloy magnetic reluctance body, the magnetic reluctance body (3) is made of one or more materials of iron alloy, copper alloy and aluminium alloy, and the solenoid coil (4) is made of copper.

* * * * *